US005742313A

United States Patent [19]

Hine

[11] Patent Number: 5,742,313

[45] Date of Patent: Apr. 21, 1998

[54] EFFICIENT INK JET HEAD ARRANGEMENT

[75] Inventor: Nathan P. Hine, South Strafford, Vt.

[73] Assignee: Spectra, Inc., Hanover, N.H.

[21] Appl. No.: 331,921

[22] Filed: Oct. 31, 1994

[51] Int. Cl.[6] ..... B41S 2/19

[52] U.S. Cl. ..... 347/92

[58] Field of Search ..... 347/88, 92, 87, 347/49

[56] References Cited

U.S. PATENT DOCUMENTS

| | | | |
|---|---|---|---|
| 4,663,222 | 5/1987 | Ohue et al. | 428/224 |
| 4,788,556 | 11/1988 | Hoisington+. | |
| 4,814,786 | 3/1989 | Hasington et al. | 347/88 |
| 4,870,430 | 9/1989 | Daggett et al. | 347/88 |
| 4,940,995 | 7/1990 | Hine et al. . | |
| 5,013,339 | 5/1991 | Mahoney et al. | 210/500.23 |
| 5,049,904 | 9/1991 | Nakamura et al. | 347/49 |
| 5,182,581 | 1/1993 | Kashimura et al. | 347/87 |
| 5,189,438 | 2/1993 | Hine et al. | 347/92 |
| 5,208,610 | 5/1993 | Su et al. | 347/49 |
| 5,260,360 | 11/1993 | Mrozinski et al. | 524/95 |
| 5,276,468 | 1/1994 | Deur et al. | 347/88 X |

FOREIGN PATENT DOCUMENTS

| | | | |
|---|---|---|---|
| 60-206658 | 10/1985 | Japan | 347/8 |
| 61-249760 | 11/1986 | Japan | 347/92 |

OTHER PUBLICATIONS

Soukhanov et al., Webster's II New Riverside University Dictionary, 1988, p. 999.

*Primary Examiner*—Benjamin R. Fuller
*Assistant Examiner*—Juanita Stephens
*Attorney, Agent, or Firm*—Brumbaugh, Graves, Donohue & Raymond

[57] ABSTRACT

In the ink jet head described in the specification, a reservoir body contains three ink reservoirs and a vacuum reservoir and a cover plate at the front of the reservoir body provides passages to supply ink from the ink reservoirs to an ink jet array from which ink is selectively ejected in response to electrical signals. Air-permeable, ink-impermeable membranes in a lung plate adjacent to the cover plate provide one wall of the ink passages, and the opposite sides of the membranes communicate with the vacuum reservoir. The reservoir body is made of a heat-conductive material and is removably received in an insulating housing containing a cartridge heater which supplies heat to the bottom of the reservoir body.

15 Claims, 4 Drawing Sheets

EFFICIENT INK JET HEAD ARRANGEMENT

BACKGROUND OF THE INVENTION

This invention relates to ink jet systems and, more particularly, to an ink jet head which is arranged to provide improved convenience and efficiency of operation.

Heretofore, ink jet heads, which are usually driven in a reciprocating motion adjacent to a substrate on which an image is produced by ink selectively ejected from the head, have been relatively large and cumbersome and often require remote stationary ink reservoirs from which ink is pumped periodically to the ink jet head. One such arrangement is disclosed in the Hoisington et al. U.S. Pat. No. 4,814,786 issued Mar. 21, 1989, the disclosure of which is incorporated herein by reference. Moreover, in ink jet systems in which dissolved air is removed from the ink by subjecting it to reduced pressure, as described, for example, in the Hoisington et al. U.S. Pat. No. 4,788,556 issued Nov. 29, 1988 and the Hine et al. U.S. Pat. No. 4,940,995 issued Jul. 10, 1990, the disclosures of which are incorporated herein by reference, a flexible line connected to a remote vacuum pump is required. More recently, in the copending Hine application Ser. No. 08/143,165 filed Oct. 26, 1993, the disclosure of which is incorporated herein by reference, a self-contained replaceable vacuum reservoir for an ink jet head is provided, and in the copending Hoisington application Ser. No. 08/143,166 filed Oct. 26, 1993, the disclosure of which is incorporated herein by reference, an ink jet head includes a replaceable ink reservoir.

Generally, such prior art arrangements have been bulky, making them inconvenient to assemble and use, relatively heavy, thereby requiring excessive power for acceleration during reciprocating motion, and relatively difficult to heat and maintain at a desired temperature for use with hot melt ink.

SUMMARY OF THE INVENTION

Accordingly, it is an object of the present invention to provide a new and improved ink jet head arrangement which overcomes the disadvantages of the prior art.

Another object of the invention is to provide an improved replaceable ink jet head arrangement having self-contained ink and vacuum reservoirs, providing improved convenience in manufacture and use and greater efficiency in operation.

These and other objects of the invention are attained by providing a housing and a reservoir body removably received in the housing and containing a plurality of ink reservoirs and a vacuum reservoir and an ink jet array containing a plurality of ink jet orifices and associated ink chambers supplied with ink by passages leading from the ink reservoirs, together with actuating elements for applying pressure to the pressure chambers to initiate ejection of ink drops through corresponding orifices. In order to remove dissolved air from the ink, which could interfere with the operation of the ink jet head, the passages leading from the ink reservoirs to the ink chambers are adjacent to a lung plate containing air-permeable, ink-impermeable membranes which communicate on one side with the ink in the passages and on the other side with the vacuum reservoir.

In one embodiment in which hot melt ink is provided, the housing is made of an insulating material having a cartridge heating element adjacent to the bottom wall of the reservoir body, which is made of a heat-conductive material such as metal, preferably aluminum. In addition, a separate heating element is provided in the ink jet array in order to maintain the ink at a desired controlled temperature when it is ejected.

BRIEF DESCRIPTION OF THE DRAWINGS

Further objects and advantages of the invention will be apparent from a reading of the following description in conjunction with the accompanying drawings, in which.

DESCRIPTION OF PREFERRED EMBODIMENT

Figure 1:
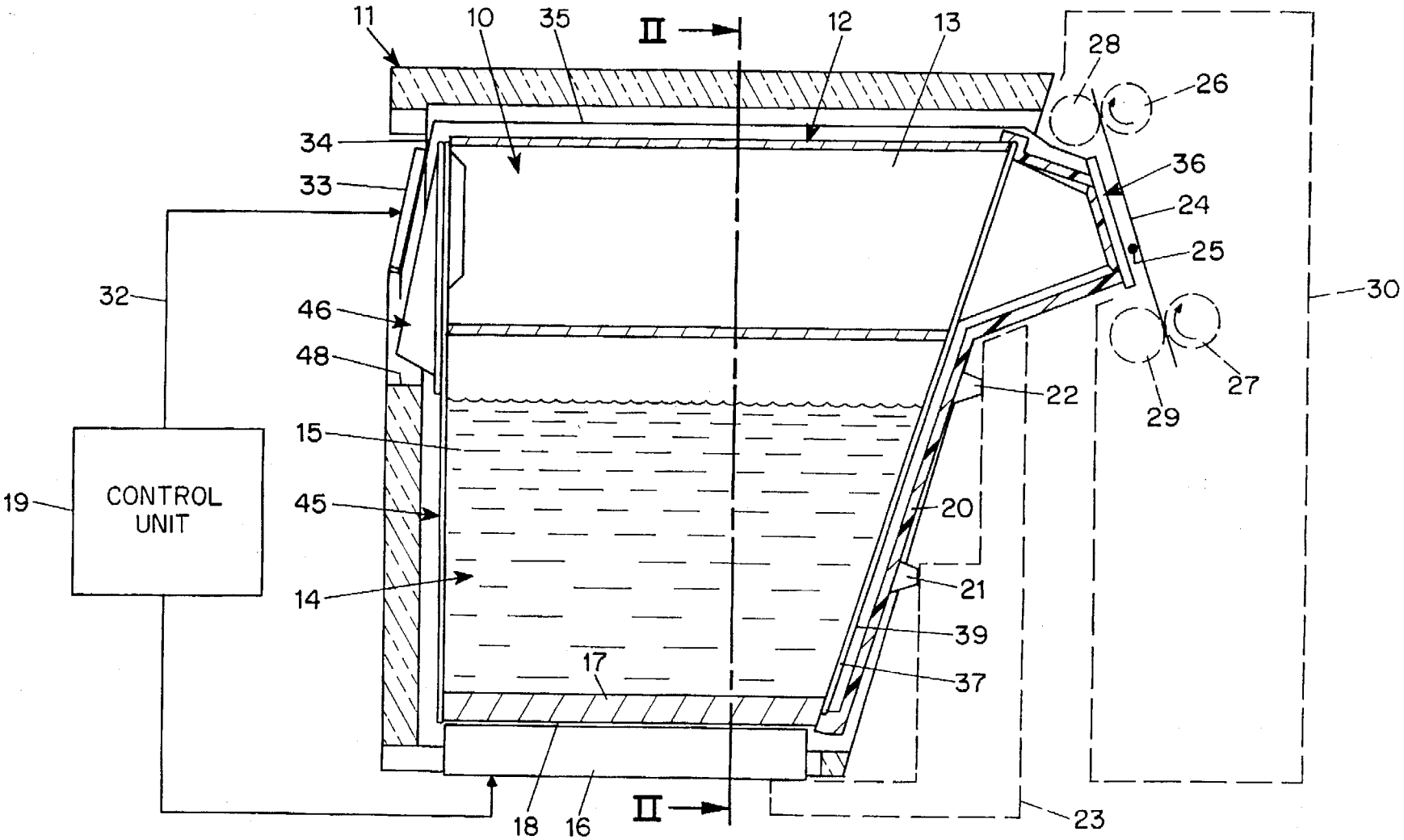
FIG. 1 is a schematic view in longitudinal section of a representative embodiment of an ink jet head arrangement in accordance with the invention.
Figure 2:
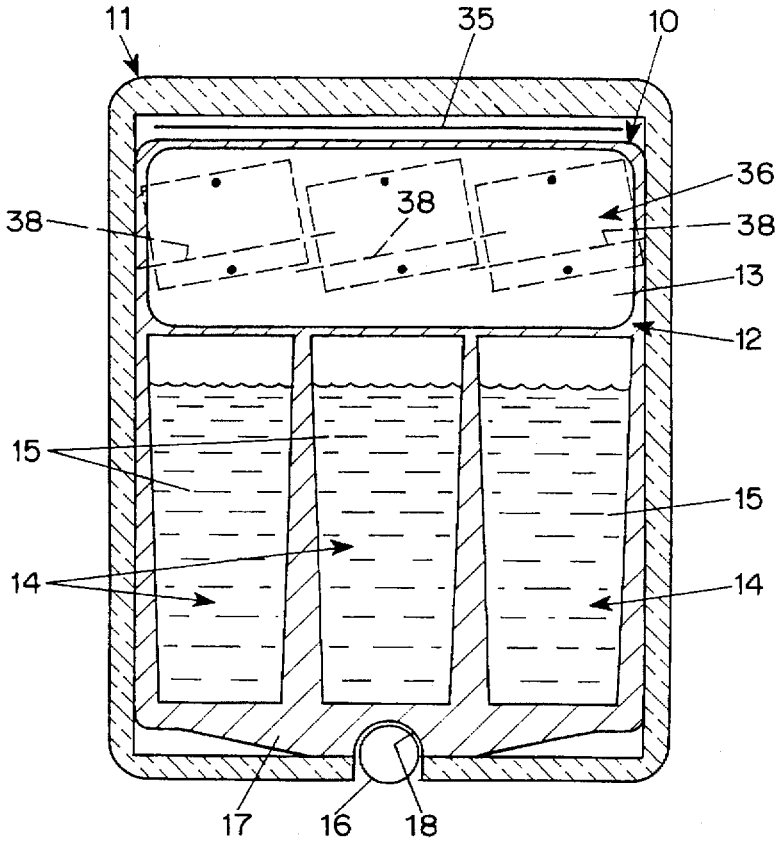
FIG. 2 is a cross-sectional view taken on the line II—II of FIG. 1 illustrating the arrangement of the reservoirs in the ink jet head.

In the representative embodiment of the invention illustrated in sectional view in FIG. 1, an ink jet head 10 is removably mounted in a protective insulating housing 11. As best seen in FIG. 2, the ink jet head 10 includes a reservoir body 12 containing a vacuum reservoir 13 in its upper portion and a plurality of laterally-adjacent ink reservoirs 14 disposed in side-by-side relation beneath the vacuum reservoir 13, each containing a supply of ink 15, which may be of a different color in each reservoir. If the ink is hot melt ink, which is normally solid at room temperature and molten at elevated temperature, a cartridge heater 16 is mounted in the housing 11 so as to be received within a recess 18 in the bottom wall 17 of the reservoir body 12. Power is supplied to the cartridge heater 16 from a control unit 19 so as to heat the ink reservoirs 14 to a temperature sufficient to melt the ink 15 in the reservoirs and then maintain the temperature of the ink in the reservoirs at a desired level.

The ink jet head 10 has a front cover 20 formed with positioning bosses 21 and 22 so as to position the ink jet head at a desired location in a carriage 23, which is schematically illustrated in dotted outline, the carriage being arranged to move the head 10 in a reciprocating motion in the usual manner adjacent to a substrate 24 on which an image is to be printed by ink drops 25 projected from the ink jet head.

The substrate 24 is conveyed by drive rolls 26 and 27 and associated nip rolls 28 and 29 disposed within a conventional paper-handling system 30, which is illustrated schematically in dotted outline in FIG. 1. As will be understood by those skilled in the art, the ink jet head 10 is reciprocated perpendicular to the plane of FIG. 1, and the substrate 24 is conveyed in a direction perpendicular to the reciprocating motion of the ink jet head 10 so that the selective ejection of ink drops 25 produces a desired image on the substrate.

For this purpose, the control unit 19 supplies signals through a line 32 to a contact pad 33 in the housing 11 which engages a contact area 34 of a flexible conductor strip 35 leading to an ink jet array 36 of the type disclosed, for example, in the copending Moynihan et al. application Ser. No. 08/215,301 filed Mar. 21, 1994, the disclosure of which is incorporated herein by reference. Ink from each of the three reservoirs 14 is conveyed through corresponding passages 37 in the front cover 20 to the ink jet array 36 for selective ejection of ink drops through orifices in a series of orifice arrays 38, illustrated schematically in dotted outlines in FIG. 2, in accordance with signals transmitted to the ink jet array by the control unit 19 through the conductor strip 35. Another heater 39 is provided in the ink jet array 36 to maintain the ink jet at a controlled temperature.

Figure 3:
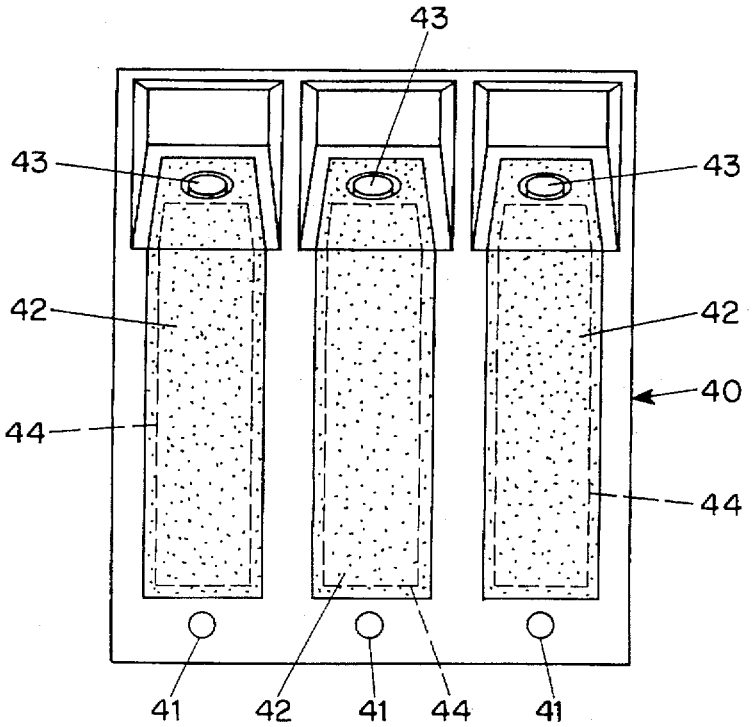
FIG. 3 is a front view showing the lung plate of the ink jet head of FIG. 1 with lung membranes mounted in position.

A lung plate 40, mounted adjacent to the front cover 20, has three apertures 41, shown in FIG. 3, through which ink from the corresponding reservoirs 14 passes to the side of the plate facing away from the reservoirs, after which it is conducted along the passages 37 formed in the cover 20. Three air-permeable, ink-impermeable membrane members 42, mounted on the lung plate 40, form one wall of the passages 37 Which lead to openings 43 in the upper part of the plate 40 communicating with corresponding orifices in the orifice arrays 38 in the ink jet array 36 to supply ink thereto. The lung plate 40 also has passages 44, shown in dotted outline in FIG. 3, formed on the opposite sides of the membranes 42 which communicate with the vacuum reservoir 13 so that subatmospheric pressure is continuously maintained on the opposite sides of the membranes 42 with respect to the ink passages 37 leading from the openings 41 to the openings 43. As a result, dissolved air contained in the ink 15 is continuously extracted from the ink as the ink passes from the reservoirs 14 to the ink chambers in the ink jet array 36. This inhibits the formation of air bubbles in the ink jet array which could result from reduced pressure applied to the ink in the pressure chambers in the array during the ejection of ink drops, as described in the above-identified Hine application Ser. No. 08/143,165.

The reservoir body 12 of the ink jet head 10 also has a rear cover 45 formed with a filter enclosure 46 in which a filter member 47 (shown in FIG. 4) is arranged to permit air to enter each of the reservoirs 14 as ink is withdrawn from them during operation of the ink jet head, a corresponding opening 48 being provided in the rear wall of the housing 11 to receive the rear cover 45. To avoid escape of ink, the filter 47 is made of a material which is not wettable by the ink 15 and has pores which are small enough to prevent ink from flowing through them if the ink jet head 10 is tilted.

In a specific embodiment, the reservoir body 12 is an integral extruded-aluminum member shaped to provide three ink reservoirs 14, each having an ink volume of about 18 cc, which is sufficient to produce about 1,300 printed pages, and a vacuum reservoir 13 having a volume of about 50 cc, and the area of each of the vacuum passages 44 exposing the membranes 42 to the reservoir vacuum is about 4 $cm^2$.

Preferably, the membranes 42 are made of polyvinylidene chloride sheet material from 2.5 to 25 μm thick, nylon sheet material from 25 to 250 μm thick, polytetrafluoroethylene sheet material from 10 to 100 μm thick or polypropylene sheet material from 25 to 250 μm thick, and are selected to provide a minimum deaeration effectiveness of about 20% at the end of a one-year shelf life or at the end of a 1,300-page ink reservoir printing life. With an initial reservoir vacuum level of about 0.1 atmosphere, this can be achieved using polyvinylidene chloride membranes approximately 13 μm thick, nylon membranes approximately 150 μm thick, polytetrafluoroethylene membranes approximately 38 μm thick, or polypropylene membranes approximately 150 μm thick. At the end of the reservoir shelf life or ink usage life, the vacuum reservoir pressure is about 0.25 atmosphere using the specified polyvinylidene chloride membranes and about 0.5 atmosphere using the other membranes having the specified thicknesses.

Figure 4:
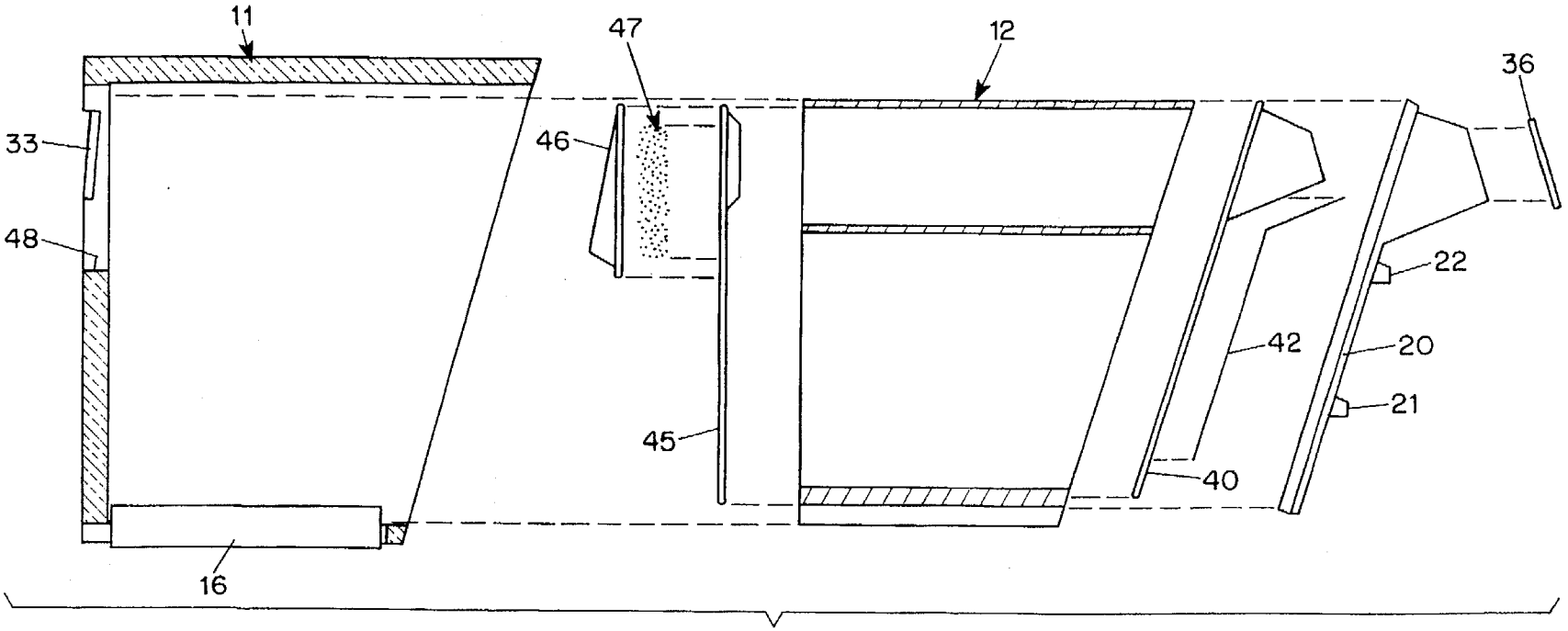
FIG. 4 is an exploded side view illustrating the arrangement of the principal components of the representative embodiment of the ink jet head shown in FIG. 1.

The exploded view of FIG. 4 illustrates the simple and convenient manner by which the ink jet head of the invention can be fabricated and assembled. In this illustration, the filter cover 46, which may be a stamped aluminum piece, for example, is adhesively bonded to the rear cover 45 with the nonwettable vent filter 47 clamped between them, and the rear cover 45 is then adhesively bonded to the extruded aluminum reservoir body 12. The lung membranes 42 are adhesively bonded to the front surface of the lung plate 40 in the manner shown in FIG. 3, and the lung plate is then adhesively bonded to the front of the aluminum reservoir body 12 to provide communication between the vacuum passages 44 and the vacuum reservoir 13. Thereafter, the front cover 20, which may be molded from a rigid synthetic material, is adhesively bonded to the reservoir body 12 and to the lung plate 40, and the ink jet array 36 of the type described, for example, in the copending application Ser. No. 08/215,301, is adhesively bonded to the front cover 20 and the lung plate 40 so that the ink passages 37 provide communication between the ink reservoirs 14 and appropriate passages in the ink jet array 36, and the conductor strip 35 shown in FIGS. 1 and 2 is connected to appropriate terminals in the ink jet array. The completed assembly is then releasably locked into the protective housing 11, into which the cartridge heater 16 and contact pad 33 have been mounted, so that the conductors in the contact area 34 of the conductor strip 35 engage appropriate contacts in the contact pad 33.

Figure 5:
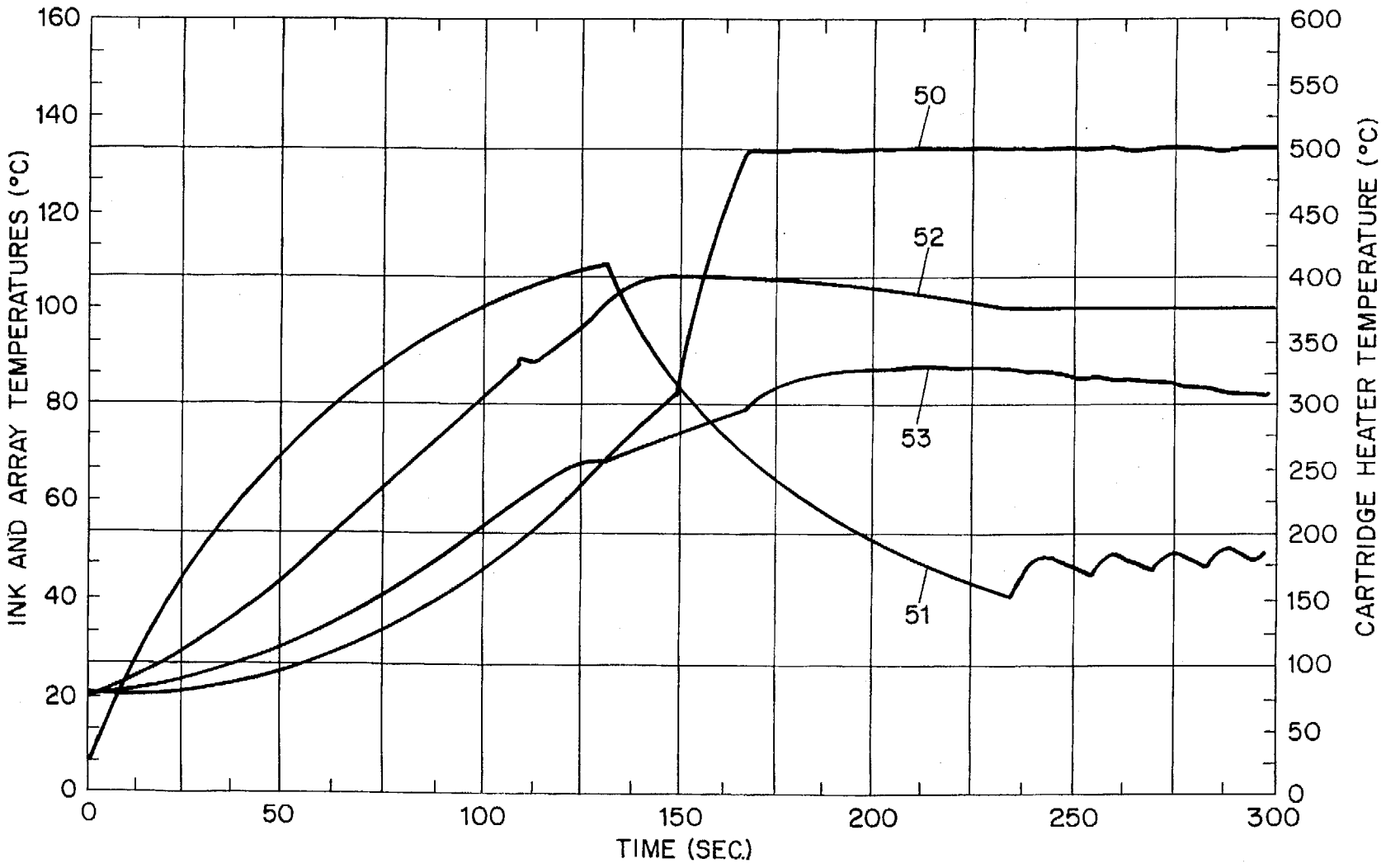
FIG. 5 is a graphical representation illustrating the temperature characteristics of the ink jet head illustrated in FIGS. 1–4 when used with hot melt ink.

FIG. 5 illustrates the temperature characteristics of an ink jet head of the type described above on start-up when used with a hot melt ink which melts at about 80° C. and is jetted at about 137° C. In the illustrated example, the heater in the ink jet array 36 is controlled by the control unit 19 to maintain the array temperature, represented by the line 50 and shown by the scale at the lefthand side of the graph, at about 137° C. At the same time, the cartridge heater temperature, represented by the line 51 and shown by the scale at the righthand side of the graph, is controlled to initially increase to a high temperature approaching 400° C. during the first two minutes of operation, and is then kept at a lower temperature below about 200° C. so as to maintain the temperature of the ink near the bottom of the reservoirs, represented by the line 52 and shown by the scale in the graph, at about 100° C. With this arrangement, the ink near the front wall of the ink reservoirs has a temperature, represented by the line 53 and shown in the lefthand scale in the graph, of about 85° C.

Thus, with the illustrated heater arrangement, the ink jet head 10 can be ready to operate within three minutes of the time when power is applied to the heaters.

Although the invention has been described herein with reference to a specific embodiment, many modifications and variations therein will readily occur to those skilled in the art. Accordingly, all such variations and modifications are included within the intended scope of the invention.

I claim:

1. An ink jet head arrangement comprising a reservoir body made of heat-conductive material containing a plurality of ink reservoirs and a vacuum reservoir, an ink jet array affixed to the reservoir body and arranged to eject ink drops selectively in response to electrical signals, and a lung plate interposed between the ink reservoirs in the reservoir body and the ink jet array having a plurality of air-permeable, ink-impermeable membranes, each membrane providing on one side one wall of one of a plurality of ink passages leading from the reservoirs to the ink jet array and each membrane communicating on another side of said membrane with the vacuum reservoir so as to extract dissolved air from ink in the ink passages without requiring a connection to an external vacuum generator.

2. An ink jet head arrangement according to claim 1 including a holder for removably receiving the ink jet head, and positioning means on the ink jet head for positioning the ink jet head with respect to a substrate to which ink is to be applied from the ink jet head.

3. An ink jet head arrangement according to claim 2 wherein the reservoir body is made of metal and the holder is made of an insulating material and further comprising first heater means mounted in the holder for heating a bottom surface of the reservoir body and second heater means for heating the ink jet array to maintain hot melt ink contained in the reservoir and ejected from the array at desired temperatures.

4. An ink jet head arrangement according to claim 1 including a filter member disposed in one wall of the reservoir body and made of a material which is not wetted by ink contained in the reservoir body to permit air to enter an ink reservoir as ink is used without permitting ink to pass out of the reservoir through the filter member.

5. An ink jet head arrangement according to claim 1 wherein the air-permeable, ink-impermeable membranes are polyvinylidene chloride membranes having a thickness between 2.5 and 25 μm and wherein the vacuum reservoir has a pressure between about 0.1 and about 0.25 atmosphere.

6. An ink jet head arrangement according to claim 1 wherein the air-permeable, ink-impermeable membranes are made of nylon having a thickness between about 25 and about 250 μm and the vacuum reservoir has a pressure between about 0.1 and about 0.5 atmosphere.

7. An ink jet head arrangement according to claim 1 wherein the air-permeable, ink-impermeable membranes are made of polytetrafluoroethylene having a thickness between about 10 and about 100 μm and the vacuum reservoir has a pressure between about 0.1 and about 0.5 atmosphere.

8. An ink jet head arrangement according to claim 1 wherein the air-permeable, ink-impermeable membranes are made of polypropylene having a thickness between about 25 and 250 μm and the vacuum reservoir has a pressure between about 0.1 and about 0.5 atmosphere.

9. An ink jet head arrangement comprising a reservoir assembly including an extruded-aluminum reservoir body member having a plurality of separate compartments and front and rear wall members adhesively bonded thereto to provide a plurality of ink reservoirs for hot melt ink in a lower portion and a vacuum reservoir in an upper portion, an ink jet array adhesively bonded to the front wall member and arranged to selectively eject ink drops through orifices in response to corresponding electrical signals, the front wall member providing a plurality of ink passages to supply ink from the reservoirs to the ink jet array, and a lung plate mounted between the extruded-aluminum member and the front wall member having a plurality of membranes forming on one side one wall of each of the plurality of ink passages and each membrane communicating on an opposite side with the vacuum reservoir to extract dissolved air from ink passing through the ink passages.

10. An ink jet head arrangement according to claim 9 including a holder made of insulating material arranged to removably receive the reservoir body and including first heater means adjacent to a lower portion of the reservoir body for heating ink contained therein in a controlled manner, and further comprising second heater means in the ink jet array for maintaining the ink jet array at a controlled temperature, and air vent means in the reservoir body permitting air to enter each of the reservoirs as ink therein is used and including a porous member made of a material which is not wettable by the ink in the reservoirs.

11. An ink jet head arrangement according to claim 10 including a conductor strip connected to the ink jet array to provide signals thereto for controlling selective ejection of ink drops therefrom, and contact means in the holder to engage conductors in the conductor strip and supply signals thereto.

12. An ink jet head arrangement according to claim 11 including control means for supplying signals to the contact means to control selective ejection of ink drops by the ink jet array.

13. An ink jet head arrangement according to claim 12 wherein the control means controls the operation of the first and second heater means to maintain ink in the reservoirs and in the ink jet array at desired temperatures.

14. An ink jet head comprising an ink reservoir body, an ink jet array, an ink passage leading from the ink reservoir body to the ink jet array to supply ink thereto, a vacuum reservoir, and an air-permeable, ink-impermeable member forming a part of the ink passage and having on one side a surface exposed to ink in the passage and having on an opposite side a surface connected to the vacuum reservoir so as to extract dissolved air from ink in the ink passage without requiring a connection to an external vacuum generator.

15. An ink jet head according to claim 14 wherein the air-permeable, ink-impermeable member comprises a material selected from a group consisting of nylon, polytetrafluoroethylene, polypropylene and polyvinylidene chloride.

* * * * *